US011530672B2

(12) United States Patent
Maeda et al.

(10) Patent No.: US 11,530,672 B2
(45) Date of Patent: Dec. 20, 2022

(54) INTERNAL COMBUSTION ENGINE

(71) Applicant: HONDA MOTOR CO., LTD., Tokyo (JP)

(72) Inventors: Yoshitaka Maeda, Tokyo (JP); Suguru Fukuda, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/577,391

(22) Filed: Jan. 18, 2022

(65) Prior Publication Data

US 2022/0228545 A1 Jul. 21, 2022

(30) Foreign Application Priority Data

Jan. 19, 2021 (JP) ..... JP2021-006330

(51) Int. Cl.
*F02M 61/18* (2006.01)
*F02M 61/14* (2006.01)

(52) U.S. Cl.
CPC .... *F02M 61/1826* (2013.01); *F02M 61/1813* (2013.01); *F02M 61/1846* (2013.01); *F02M 61/145* (2013.01)

(58) Field of Classification Search
CPC ..... F02M 61/1826
See application file for complete search history.

(56) References Cited

U.S. PATENT DOCUMENTS 5,540,200 A * 7/1996 Naitoh ..... F02M 61/1826 123/585
6,520,145 B2 * 2/2003 Hunkert ..... F02M 61/1806 239/584
6,802,296 B2 * 10/2004 Arndt ..... F02M 61/1853 123/305
7,216,624 B2 * 5/2007 Mizobuchi ..... F02M 61/184 123/305
7,237,527 B2 * 7/2007 Pontoppidan ..... F02M 61/1826 123/298
7,243,862 B2 * 7/2007 Dingle ..... F02M 61/06 239/408
7,770,556 B2 * 8/2010 Kihara ..... F02B 23/104 123/299

(Continued)

FOREIGN PATENT DOCUMENTS

CN 105473844 A * 4/2016 ..... F02M 61/1826
CN 106232981 A * 12/2016 ..... F02M 51/06

(Continued)

*Primary Examiner* — Kevin R Steckbauer
(74) *Attorney, Agent, or Firm* — CKC & Partners Co., LLC

(57) ABSTRACT

The present disclosure is intended to provide an internal combustion engine that can inhibit fuel from adhering to a piston and can reduce generation of soot. An internal combustion engine includes a piston, a cylinder accommodating the piston, and an injector including a nozzle that has a plurality of nozzle holes configured to inject fuel into the cylinder from above the cylinder. Among the plurality of nozzle holes, a sixth nozzle hole an axial direction of which is the most deflected toward the piston has a nozzle hole diameter larger than nozzle hole diameters of the other nozzle holes, and the nozzle hole diameter of the sixth nozzle hole corresponds to at least 20% of the total of the nozzle hole diameters of the other nozzle holes.

2 Claims, 6 Drawing Sheets

(56) References Cited

U.S. PATENT DOCUMENTS

| | | | | |
|---|---|---|---|---|
| 8,657,214 | B2 * | 2/2014 | Matsumura | F02M 61/1813 239/533.3 |
| 9,309,853 | B2 * | 4/2016 | Okamoto | F02M 69/04 |
| 9,494,119 | B2 * | 11/2016 | Kato | F02B 23/104 |
| 9,709,010 | B2 * | 7/2017 | Kato | F02M 61/1813 |
| 9,828,961 | B2 * | 11/2017 | Kaneta | F02M 61/1826 |
| 9,951,736 | B2 * | 4/2018 | Powell | F02M 61/166 |
| 10,208,722 | B2 * | 2/2019 | Kato | F02M 61/1813 |
| 10,260,470 | B2 * | 4/2019 | Kaneta | F02M 61/1846 |
| 10,502,171 | B2 * | 12/2019 | Mulye | F02M 61/1813 |
| 10,989,105 | B2 * | 4/2021 | Kusakabe | F02M 61/18 |
| 11,045,776 | B2 * | 6/2021 | Zhang | F02M 61/163 |
| 11,136,954 | B2 * | 10/2021 | Hosaka | F02M 61/1813 |
| 11,143,153 | B2 * | 10/2021 | Mulye | F02M 61/1846 |
| 2007/0000476 | A1 * | 1/2007 | Mizobuchi | F02M 61/1846 123/305 |
| 2015/0159612 | A1 * | 6/2015 | Kato | F02B 23/104 123/295 |
| 2016/0195052 | A1 * | 7/2016 | Kaneta | F02M 61/1833 123/299 |
| 2017/0009717 | A1 * | 1/2017 | Kato | F02M 61/1813 |
| 2017/0292483 | A1 * | 10/2017 | Kato | F02M 61/1846 |
| 2018/0045157 | A1 * | 2/2018 | Kaneta | F02M 61/1833 |
| 2019/0040790 | A1 * | 2/2019 | Kusakabe | F02M 61/18 |
| 2020/0061554 | A1 * | 2/2020 | Zhang | B01F 25/31242 |
| 2021/0190025 | A1 * | 6/2021 | Hosaka | F02M 61/1846 |

FOREIGN PATENT DOCUMENTS

| | | | | |
|---|---|---|---|---|
| CN | 108700012 | A * | 10/2018 | F02B 17/005 |
| CN | 110857679 | A * | 3/2020 | B01F 5/0426 |
| CN | 110985255 | A * | 4/2020 | F02M 61/1813 |
| CN | 108700012 | B * | 11/2020 | F02B 17/005 |
| DE | 112014003551 | T5 * | 5/2016 | F02M 61/1826 |
| DE | 202015006983 | U1 * | 6/2016 | F02M 61/06 |
| DE | 112015002838 | T5 * | 3/2017 | F02M 51/06 |
| DE | 102015223437 | A1 * | 6/2017 | F02M 61/06 |
| DE | 112017000305 | T5 * | 10/2018 | F02B 17/005 |
| DE | 102017116244 | A1 * | 1/2019 | F02B 23/0669 |
| DE | 112018000602 | T5 * | 11/2019 | F02M 51/0685 |
| DE | 102019122546 | A1 * | 2/2020 | B01F 5/0426 |
| DE | 102019126545 | A1 * | 4/2020 | F02M 61/1813 |
| DE | 112018005431 | T5 * | 7/2020 | F02M 61/04 |
| DE | 112020000270 | T5 * | 9/2021 | F02D 41/401 |
| EP | 1741924 | A1 * | 1/2007 | F02B 23/104 |
| EP | 3173614 | A1 * | 5/2017 | F02M 61/06 |
| EP | 3892847 | A1 * | 10/2021 | F02B 23/104 |
| FR | 2876750 | A1 * | 4/2006 | F02B 23/0669 |
| FR | 2887586 | A1 * | 12/2006 | F02B 23/06 |
| FR | 3071016 | A1 * | 3/2019 | F02M 45/086 |
| GB | 2034816 | A * | 6/1980 | F02M 61/182 |
| GB | 2593892 | A * | 10/2021 | F02B 23/104 |
| JP | 2001248524 | A * | 9/2001 | F02M 45/086 |
| JP | 2003214297 | A * | 7/2003 | F02B 23/0669 |
| JP | 2004162577 | A * | 6/2004 | B01F 5/0426 |
| JP | 2004162577 | A | 6/2004 | |
| JP | 3745232 | B2 * | 2/2006 | F02M 61/1846 |
| JP | 2007292035 | A * | 11/2007 | F02B 23/104 |
| JP | 4154317 | B2 * | 9/2008 | F02M 61/162 |
| JP | 4619989 | B2 * | 1/2011 | F02B 23/104 |
| JP | 2015031212 | A * | 2/2015 | F02M 61/1826 |
| JP | 2015113765 | A * | 6/2015 | F02B 23/101 |
| JP | 2016003593 | A * | 1/2016 | F02M 51/06 |
| JP | 6020380 | B2 * | 11/2016 | F02M 61/1826 |
| JP | 6166168 | B2 * | 7/2017 | F02B 23/101 |
| JP | 6311472 | B2 * | 4/2018 | F02M 51/06 |
| JP | 2019100321 | A * | 6/2019 | F02M 61/04 |
| JP | 2019116900 | A * | 7/2019 | F02B 17/005 |
| JP | 6725723 | B2 * | 7/2020 | F02B 17/005 |
| JP | 6839796 | B2 * | 3/2021 | F02B 17/005 |
| JP | 6951224 | B2 * | 10/2021 | F02M 61/04 |
| NL | 8602687 | A * | 5/1988 | F02M 61/182 |
| WO | WO-0190571 | A2 * | 11/2001 | F02M 61/1826 |
| WO | WO-2009055315 | A2 * | 4/2009 | F02M 61/06 |
| WO | WO-2015015797 | A1 * | 2/2015 | F02M 61/1826 |
| WO | WO-2015194071 | A1 * | 12/2015 | F02M 51/06 |
| WO | WO-2017145527 | A1 * | 8/2017 | F02B 17/005 |
| WO | WO-2019111643 | A1 * | 6/2019 | F02M 61/04 |

* cited by examiner

INTERNAL COMBUSTION ENGINE

This application is based on and claims the benefit of priority from Japanese Patent Application No. 2021-006330, filed on 19 Jan. 2021, the content of which is incorporated herein by reference.

BACKGROUND OF THE INVENTION

Field of the Invention

The present disclosure relates to an internal combustion engine.

Related Art

Direct injection-type internal combustion engines have been known. An internal combustion engine of this type includes a piston that reciprocates in a cylinder, and an ignition plug and a fuel injection nozzle (injector) that face a combustion chamber provided in the cylinder. In the internal combustion engine, while the cylinder is generally filled with a lean air-fuel mixture, fuel is directly injected into the cylinder from the fuel injection nozzle, so that a stratified air-fuel mixture with good ignitability is generated only in the vicinity of the fuel injection nozzle, thereby enabling stratified charge combustion (see, for example, Patent Document 1).

Patent Document 1: Japanese Unexamined Patent Application, Publication No. 2004-162577

SUMMARY OF THE INVENTION

However, according to the conventional technique, fuel is injected to a position above the center of a vortex of a swirl flow in the vertical direction (hereinafter referred to as the intake tumble flow) in the cylinder. As a result, the fuel is carried away by the intake tumble flow toward a cylinder sleeve end to collide with the vicinity of the cylinder sleeve end. This may cause a large amount of the fuel to adhere to the piston.

The present disclosure has been achieved in view of the above circumstances, and is intended to provide an internal combustion engine that can inhibit fuel from adhering to a piston and can reduce generation of soot.

To achieve the above object, a first aspect of the present disclosure provides an internal combustion engine (e.g., an engine 1 to be described later) including a piston (e.g., a piston 20 to be described later), a cylinder (e.g., a cylinder 30 to be described later) accommodating the piston, and an injector (e.g., an injector 10 to be described later including a nozzle (e.g., a nozzle 12 to be described later) that has a plurality of nozzle holes (e.g., nozzle holes 121 to 126 to be described later) configured to inject fuel into the cylinder from above the cylinder. Among the plurality of nozzle holes, one nozzle hole (e.g., a sixth nozzle hole 126 to be described later) an axial direction of which is most deflected toward the piston has a nozzle hole diameter larger than nozzle hole diameters of other nozzle holes. The nozzle hole diameter of the one nozzle hole corresponds to at least 20% of a total of the nozzle hole diameters of the other nozzle holes.

A second aspect of the present disclosure is an embodiment of the first aspect. In the internal combustion engine of the second aspect, all the other nozzle holes may be arranged such that when viewed in an isometric perspective view, division of a length of a straight line extending from a center of each nozzle hole in the axial direction of the nozzle hole to an opposite side wall surface of the cylinder by the nozzle hole diameter of the nozzle hole gives a quotient of 545 or more. At the same time, all the other nozzle holes may be arranged such that when viewed in a planar view, division of a length of a straight line extending from the center of each nozzle hole in the axial direction of the nozzle hole to the opposite side wall surface of the cylinder by the nozzle hole diameter of the nozzle hole gives a quotient of 393 or more.

In the internal combustion engine of the first or second aspect, the plurality of nozzle holes may include: a first nozzle hole (e.g., a first nozzle hole 121 to be described later) as an uppermost one among the plurality of nozzle hole; a sixth nozzle hole (e.g., a sixth nozzle hole 126 to be described later) as a lowermost one among the plurality of nozzle holes, the sixth nozzle hole having the axial direction that is the most deflected toward the piston; a second nozzle hole (e.g., a second nozzle hole 122 to be described later) and a third nozzle hole (e.g., a third nozzle hole 123 to be described later) that are disposed at positions symmetrical to each other with respect to a center line passing through a center of the first nozzle hole and a center of the sixth nozzle hole and that are adjacent to the first nozzle hole; and a fourth nozzle hole (e.g., a fourth nozzle hole 124 to be described later) and a fifth nozzle hole (e.g., a fifth nozzle hole 125 to be described later) that are disposed at positions symmetrical to each other with respect to the center line and that are adjacent to the sixth nozzle hole. The nozzle hole diameters of the second and third nozzle holes may be smaller than those of the first, fourth, and fifth nozzle holes.

The present disclosure provides an internal combustion engine that can inhibit fuel from adhering to the piston and can reduce generation of soot.

DETAILED DESCRIPTION OF THE INVENTION

An embodiment of the present disclosure will be described in detail with reference to the drawings.

Figure 1:
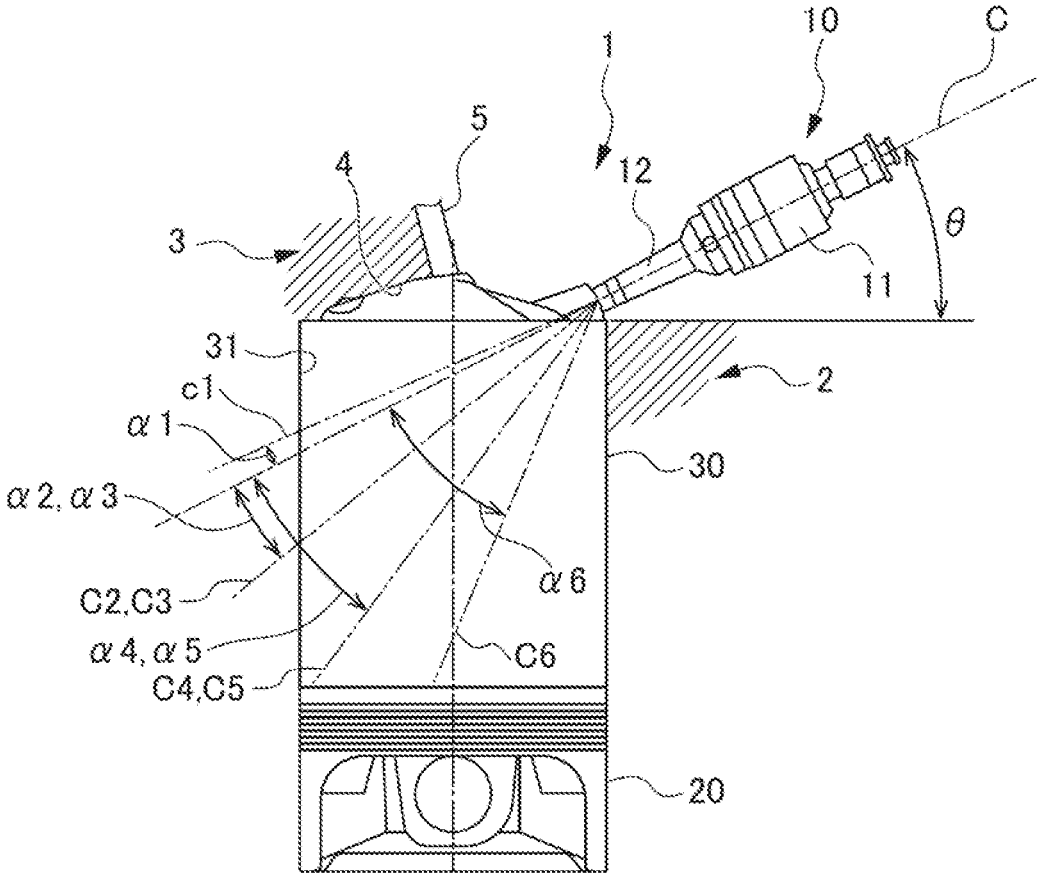
FIG. 1 is a longitudinal cross-sectional view of an internal combustion engine according to an embodiment of the present disclosure.

FIG. 1 is a longitudinal cross-sectional view of an internal combustion engine 1 (hereinafter referred to as the "engine 1") according to the present embodiment. The engine 1 is, for example, an in-line four-cylinder gasoline engine and is mountable on a vehicle (not illustrated). The engine 1 includes a piston 20, a cylinder 30, and an injector 10.

The engine 1 further includes a cylinder block 2 and a cylinder head 3 provided on top of the cylinder block 2. The cylinder 30 having a cylindrical shape and opening upward is formed in the cylinder block 2.

The cylinder 30 accommodates therein the piston 20 such that the piston 20 can slidingly reciprocate. The piston 20 is coupled to the crankshaft (not illustrated), and slidingly reciprocates in the cylinder 30 according to a crank angle, as the engine 1 operates. The piston 20 has, on its top surface, a cavity (not illustrated) into which fuel is injected.

The cylinder head 3 is placed on the cylinder block 2 to cover the cylinder 30. A combustion chamber 4 is formed between the cylinder head 3 and the top surface of the piston 20. The cylinder head 3 has an intake port and an exhaust port (both not illustrated) that open at the combustion chamber 4, and is provided with an intake valve and an exhaust valve (both not illustrated) that open and close the intake and exhaust ports.

The cylinder head 3 is further provided with an ignition plug 5 and the injector (fuel injection nozzle) 10.

The ignition plug 5 is mounted approximately vertically on the cylinder head 3. The ignition plug 5 faces a vicinity of the center of the combustion chamber 4 from above and emits sparks to ignite an air-fuel mixture. The timing (ignition timing) at which the ignition plug 5 emits sparks is controlled by an ECU (not illustrated) according to an operating state of the engine 1.

The injector 10 includes an injector body 11, a nozzle 12 provided at a leading end of the injector body 11, and a solenoid valve (not illustrated) incorporated in the injector body 11 and having a solenoid, a needle valve, etc. The nozzle 12 has, on its leading end surface, a plurality of nozzle holes that face the combustion chamber.

The injector 10 is supplied with a high-pressure fuel from a fuel pump (not illustrated). When the needle valve opens, streams of spray of the fuel are injected through the plurality of nozzle holes into the cylinder 30 at predetermined different angles. The amount of the fuel to be injected by the injector 10 and the injection timing are controlled by the ECU (not illustrated) according to an operating state of the engine 1.

As illustrated in FIG. 1, the injector 10 of the present embodiment is disposed close to the intake port of the cylinder head 3, and is obliquely mounted at an inclination angle θ with respect to the horizontal direction. That is, the injector 10 of the present embodiment is not located directly above the cylinder 30. The nozzle 12 of the injector 10 has six nozzle holes including first to sixth nozzle holes formed in the leading end surface of the nozzle 12. Each of the six nozzle holes injects the fuel into the cylinder 30 from above the cylinder 30.

Next, the six nozzle holes provided to the injector 10 of the present embodiment will be described in detail with reference to FIGS. 1 to 4.

Figure 2:
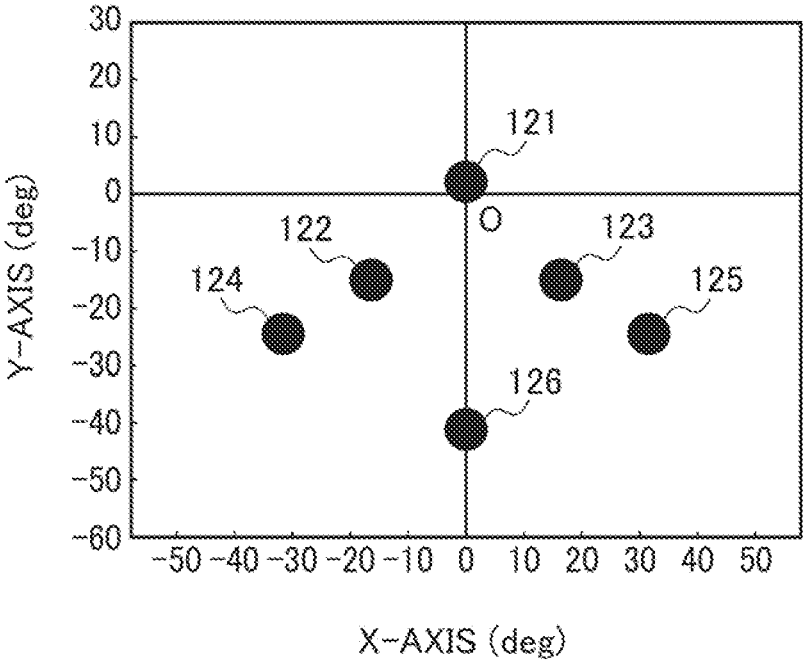
FIG. 2 is a diagram illustrating arrangement of a plurality of nozzle holes provided to an injector of the internal combustion engine according to the embodiment of the present disclosure.
Figure 3:
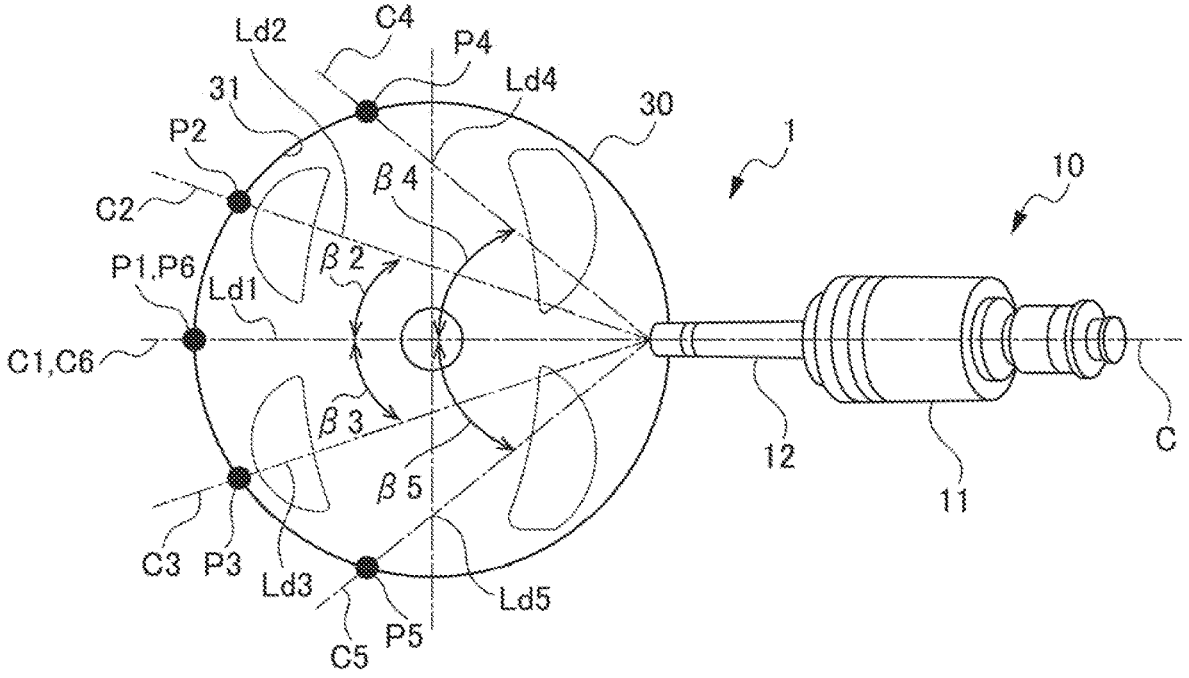
FIG. 3 is a planar view illustrating the internal combustion engine according to the embodiment of the present disclosure.
Figure 4:
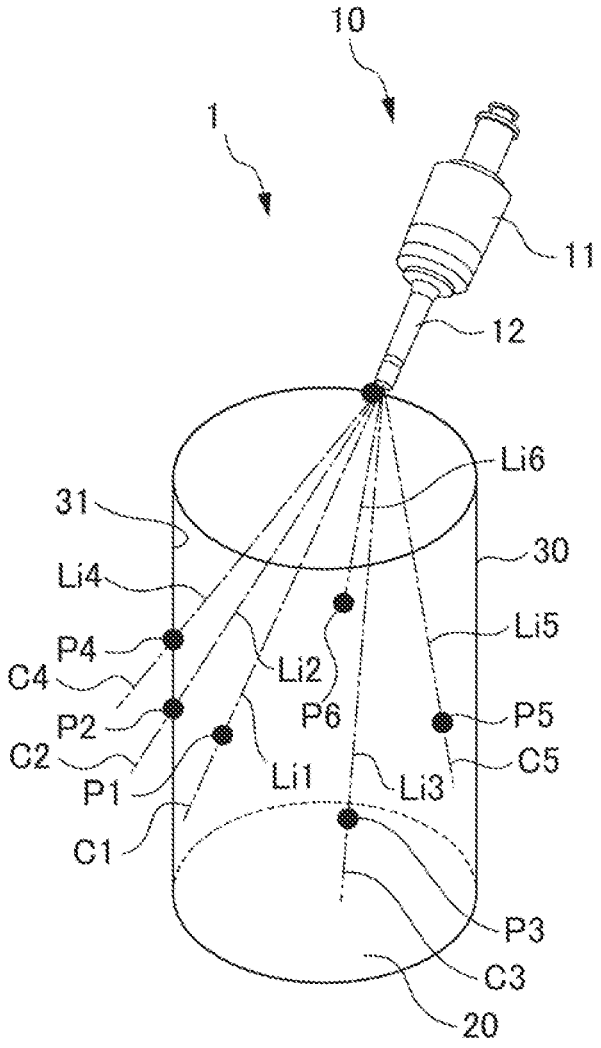
FIG. 4 is an isometric projection of the internal combustion engine according to the embodiment of the present disclosure.

FIG. 2 is a diagram illustrating arrangement of the plurality of nozzle holes (the first nozzle hole 121, the second nozzle hole 122, the third nozzle hole 123, the fourth nozzle hole 124, the fifth nozzle hole 125, and the sixth nozzle hole 126) provided to the injector 10 of the engine 1 according to the present embodiment. FIG. 3 is a planar view illustrating the engine 1 according to the present embodiment. FIG. 4 is an isometric projection of the engine 1 according to the present embodiment.

When viewed in the side view illustrated in FIG. 1, an axis C1 of the first nozzle hole 121 is inclined upward at an angle α1 with respect to a central axis C of the injector 10. An axis C2 of the second nozzle hole 122 is inclined downward at an angle α2 with respect to the central axis C. An axis C3 of the third nozzle hole 123 is inclined downward at an angle α3 with respect to the central axis C. The inclination angles α2 and α3 are the same as each other. An axis C4 of the fourth nozzle hole 124 is inclined downward at an angle α4 with respect to the central axis C. An axis C5 of the fifth nozzle hole 125 is inclined downward at an angle α5 with respect to the central axis C. The inclination angles α4 and α5 are the same as each other. An axis C6 of the sixth nozzle hole 126 is inclined downward at an angle α6 with respect to the central axis C. The axis of each nozzle hole refers to a central axis of a fuel flow path formed by the nozzle hole.

The above-mentioned inclination angles satisfy the size relationship described as $\alpha 1<\alpha 2=\alpha 3<\alpha 4=\alpha 5<\alpha 6$. That is, among the six nozzle holes, the axial direction of the axis C6 of the sixth nozzle hole 126 is inclined most downward and is most deflected toward the piston 20. The sixth nozzle hole 126, the axis of which is the most deflected toward the piston, is the most distant from an opposite side wall surface 31 of the cylinder 30. The present embodiment has the following feature. Among the plurality of nozzle holes provided to the injector 10, the sixth nozzle hole 126, which is the most distant from the opposite side wall surface 31 of the opposing cylinder 30 because of its axial direction being the most deflected toward the piston 20, has a larger nozzle hole diameter than any of the first to fifth nozzle holes 121 to 125 (hereinafter referred to also as the other nozzle holes). This feature will be described later in detail.

As illustrated in FIG. 2, the injector 10 has the plurality of nozzle holes: the first nozzle hole 121, the second nozzle hole 122, the third nozzle hole 123, the fourth nozzle hole 124, the fifth nozzle hole 125, and the sixth nozzle hole 126. The first to sixth nozzle holes are arranged symmetrically with respect to the central axis C of the injector 10, and inject fuel symmetrically with respect to the central axis C of the injector 10.

In FIG. 2, the origin O corresponds to the direction that coincides with the central axis C of the injector 10. The lateral direction with respect to the origin O (X-axis direction) represents the left side and right side of the central axis C of the injector 10 as viewed from the injector 10. The vertical direction with respect to the origin O (Y-axis direction) represents the far side (far side from the injector body 11) and the near side (close side to the injector body 11) relative to the central axis C of the injector 10. A larger distance from the origin O indicates a larger angle with respect to the central axis C of the injector 10.

As illustrated in FIG. 2, the first nozzle hole 121 is the uppermost one among the plurality of nozzle holes. The sixth nozzle hole 126 is the lowermost one among the plurality of nozzle holes, and is at the largest angle (largest inclination angle) with respect to the central axis C of the injector 10. That is, the axial direction of the axis C6 of the sixth nozzle hole 126 is the most deflected toward the piston 20.

The second nozzle hole 122 and the third nozzle hole 123 are at positions symmetrical to each other with respect to a center line passing through the center of the first nozzle hole 121 and the center of the sixth nozzle hole 126 (a straight line passing through the origin O and extending in the Y-axis direction in FIG. 2), and are disposed adjacent to the first nozzle hole 121 in the Y-axis direction.

The fourth nozzle hole 124 and the fifth nozzle hole 125 are at positions symmetrical to each other with respect to the center line passing through the center of the first nozzle hole 121 and the center of the sixth nozzle hole 126 (the straight line passing through the origin O and extending in the Y-axis direction in FIG. 2), and are disposed adjacent to the sixth nozzle hole 126 in the Y-axis direction. The fourth nozzle hole 124 and fifth nozzle hole 125 are respectively disposed outside the second nozzle hole 122 and third nozzle hole 123 in the lateral direction with respect to the central axis C of the injector 10.

Table 1 summarizes, for each of the nozzle holes, the angles with respect to the central axis C (in the lateral direction (X-axis direction) and in the vertical direction (Y-axis direction)), the nozzle hole diameter, and a ratio of the nozzle hole diameter to the total of the diameters of all the six nozzle holes.

TABLE 1

| Nozzle Hole | First | Second | Third | Fourth | Fifth | Sixth |
|---|---|---|---|---|---|---|
| X(deg) | 0 | −14.8 | 14.8 | −28.0 | 28.0 | 0 |
| Y(deg) | −3.6 | 11.8 | 11.8 | 26.3 | 26.3 | 39.6 |
| Nozzle Hole Diameter D (mm) | 0.142 | 0.122 | 0.122 | 0.142 | 0.142 | 0.17 |
| Ratio of Nozzle Hole Diameter | 16.9% | 12.5% | 12.5% | 16.9% | 16.9% | 24.3% |

As shown in Table 1, among the plurality of nozzle holes provided to the injector 10 of the present embodiment, the sixth nozzle hole 126, the axial direction of which is the most deflected toward the piston 20, is larger in nozzle hole diameter than any of the other nozzle holes. As described above, the sixth nozzle hole 126, the axis of which is the most deflected toward the piston, is the nozzle hole most distant from the opposite side wall surface 31 of the cylinder 30. In addition, the sixth nozzle hole 126, which is the most deflected toward the piston, can point and inject fuel toward the center of a vortex with weak flow in a tumble flow having at least vertical swirl flow. In other words, the present embodiment has the following feature. Among the plurality of nozzle holes provided to the injector 10, the sixth nozzle hole 126, which is the most distant from the opposite side wall surface 31 of the opposing cylinder 30 because of its axial direction being the most deflected toward the piston 20 and which can point and inject fuel toward the center of a vortex with weak flow in an intake tumble flow, has a larger nozzle hole diameter than any of the first to fifth nozzle holes 121 to 125 (hereinafter referred to also as the other nozzle holes).

The above feature is based on the following fact. As a nozzle hole diameter increases, a flow rate of fuel and a droplet diameter of fuel increase, thereby enhancing penetration (spray reach distance). The sixth nozzle hole 126, which is the most distant from the opposite side wall surface 31 of the opposing cylinder 30 because of its axial direction being the most deflected toward the piston 20, can inhibit fuel adhesion to the piston 20 even though the sixth nozzle hole 126 has a large nozzle hole diameter. This will be described later in detail.

Specifically, as shown in Table 1, the present embodiment has the configuration in which the sixth nozzle hole 126 has a nozzle hole diameter corresponding to at least 20%, specifically 24.3%, of the total of the nozzle hole diameters of the other nozzle holes. This configuration makes it possible to further reliably inhibit adhesion of fuel to the piston 20.

The above feature is also based on the fact that the sixth nozzle hole 126, which is the most deflected toward the piston, can point and inject fuel toward the center of a vortex with weak flow in an intake tumble flow, whereby the fuel is caused to stagnate around the center of the vortex and is inhibited from being carried away by the intake tumble flow and adhering to the piston 20. This will also be described in detail later.

As shown in Table 1, it is preferable that the second nozzle hole 122 and the third nozzle hole 123 have the same nozzle hole diameter. Likewise, it is preferable that the first nozzle hole 121, the fourth nozzle hole 124, and the fifth nozzle hole 125 have the same nozzle hole diameter. Furthermore, it is preferable that the nozzle hole diameters of the second and third nozzle holes 122 and 123 are smaller than those of the first, fourth, and fifth nozzle holes 121, 124 and 125. This configuration inhibits interference between the fuel flows injected from the nozzle holes.

The other nozzle holes including the first to fifth nozzle holes 121 to 125 will be described in more detail with reference to FIGS. 3 and 4.

All the first to fifth nozzle holes 121 to 125 of the engine 1 of the present embodiment are preferably arranged such that when viewed in the planar view of FIG. 3, division of the length of a straight line extending from the center of each nozzle hole in the axial direction of the nozzle hole to the opposite side wall surface 31 of the cylinder 30 (wall surface of the cylinder sleeve) by the nozzle hole diameter of the nozzle hole gives a quotient of 393 or more. In other words, when the linear distance from the center of each nozzle hole to the opposite side wall surface 31 of the cylinder 30 as viewed in the planar view is represented by Ld (mm), and the nozzle hole diameter of the nozzle hole is represented by D (mm), it is preferable that a ratio Xd of the linear distance Ld to the nozzle hole diameter D given according to the following Formula (1) is 393 or more.

[Formula]

$$Xd=Ld/D \qquad \text{Formula (1)}$$

Likewise, all the first to fifth nozzle holes 121 to 125 of the engine 1 of the present embodiment are preferably arranged such that when viewed in the isometric perspective view illustrated in FIG. 4, division of the length of a straight line extending from the center of each nozzle hole in the axial direction of the nozzle hole to the opposite side wall surface 31 of the cylinder 30 (wall surface of the cylinder sleeve) by the nozzle hole diameter of the nozzle hole gives a quotient of 545 or more. In other words, when the linear distance from the center of each nozzle hole to the opposite side wall surface 31 of the cylinder 30 in the isometric perspective view is represented by Li (mm), and the nozzle hole diameter of the nozzle hole is represented by D (mm), it is preferable that a ratio Xi of the linear distance Li to the nozzle hole diameter D given according to the following Formula (2) is 545 or more.

[Formula]

$$Xi=Li/D \qquad \text{Formula (2)}$$

Table 2 summarizes the nozzle hole diameter D, the ratio of the nozzle hole diameter, the linear distance Li, the ratio Xi of the linear distance Li to the nozzle hole diameter D, the linear distance Ld, and the ratio Xd of the linear distance Ld to the nozzle hole diameter D of the first to fifth nozzle holes 121 to 125.

TABLE 2

| Nozzle Hole | First | Second | Third | Fourth | Fifth |
|---|---|---|---|---|---|
| Nozzle Hole Diameter D (mm) | 0.142 | 0.122 | 0.122 | 0.142 | 0.142 |
| Ratio of Nozzle Hole Diameter | 16.9% | 12.5% | 12.5% | 16.9% | 16.9% |
| Linear Distance Li from Center of Nozzle Hole to Opposite Side Wall Surface of Cylinder in Isometric Perspective View (mm) | 82.5 | 85.2 | 85.2 | 77.4 | 77.4 |
| Ratio Xi of Linear Distance Li to Nozzle Hole Diameter D | 581 | 698 | 698 | 545 | 545 |
| Linear Distance Ld from Center of Nozzle Hole to Opposite Side Wall Surface of Cylinder in Planar View (mm) | 78.2 | 71.4 | 71.4 | 55.8 | 55.8 |
| Ratio Xd of Linear Distance Ld to Nozzle Hole Diameter D | 551 | 585 | 585 | 393 | 393 |

In the planar view illustrated in FIG. 3, P1 to P5 denote intersection points of the straight lines respectively extending from the centers of the first to fifth nozzle holes 121 to 125 along their respective axes C1 to C5, with the opposite side wall surface 31 of the cylinder 30. The distances between the centers of the nozzle holes and the respective intersection points P1 to P5 correspond to the linear distances Ld (Ld1 to Ld5) associated with the nozzle holes. In FIG. 3, inclination angles 31 to 135 with respect to the central axis C of the injector 10 correspond to the angles with respect to the X-axis direction listed in Table 1.

In the isometric perspective view illustrated in FIG. 4, P1 to P5 denote intersection points of the straight lines respectively extending from the centers of the first to fifth nozzle holes 121 to 125 along their respective axes C1 to C5, with the opposite side wall surface 31 of the cylinder 30. The distances between the centers of the nozzle holes and the respective intersection points P1 to P5 correspond to the linear distances Li (Li1 to Li5) associated with the nozzle holes.

Table 3 summarizes events that are caused by an increase and a decrease in each of the nozzle hole diameter D, the linear distance Li, the ratio Xi of the linear distance Li to the nozzle hole diameter D, the linear distance Ld, and the ratio Xd of the linear distance Ld to the nozzle hole diameter D.

TABLE 3

| | | Events |
|---|---|---|
| Xi, Xd | Decrease | Adhesion of fuel easily takes place. |
| | Increase | Adhesion of fuel less easily takes place. |
| Li, Ld | Decrease | Fuel moves over a short distance until reaching the opposite side wall surface. |
| | Increase | Fuel moves over a long distance until reaching the opposite side wall surface. |
| D | Increase | A high flow rate increases an amount of adhering fuel.<br>Great penetration makes it easy for fuel to reach the opposite side wall surface.<br>Adhesion of fuel easily takes place due to fuel droplets with a large diameter. |
| | Decrease | A low flow rate reduces an amount of adhering fuel.<br>Low penetration makes it less easy for fuel to reach the opposite side wall surface.<br>Adhesion of fuel less easily takes place due to fuel droplets with a small diameter. |

From Table 3, it can be appreciated that setting the ratio Xi of the linear distance Li to the nozzle hole diameter D and the ratio Xd of the linear distance Ld to the nozzle hole diameter D to large values makes it possible to inhibit adhesion of fuel to the piston 20. On the other hand, as shown in Table 2, for all the first to fifth nozzle holes 121 to 125 of the present embodiment, the ratio Xi of the linear distance Li to the nozzle hole diameter D is set to a value equal to or larger than 393 and the ratio Xd of the linear distance Ld to the nozzle hole diameter D is set to a value equal to or larger than 545. Therefore, it can be appreciated that the present embodiment can inhibit adhesion of fuel to the piston 20 and can reduce generation of soot.

Figure 5:
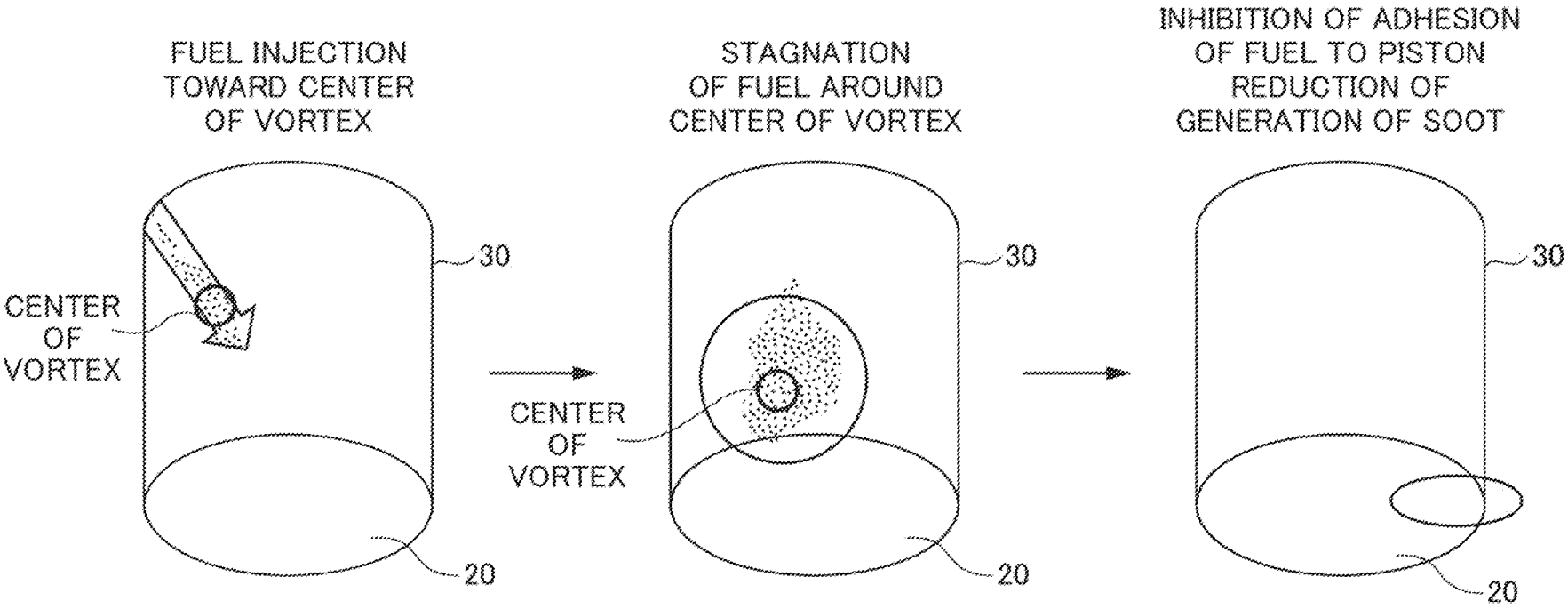
FIG. 5 is a diagram illustrating a flow of fuel injected from a sixth nozzle hole of the injector of the internal combustion engine according to the embodiment of the present disclosure.
Figure 6:
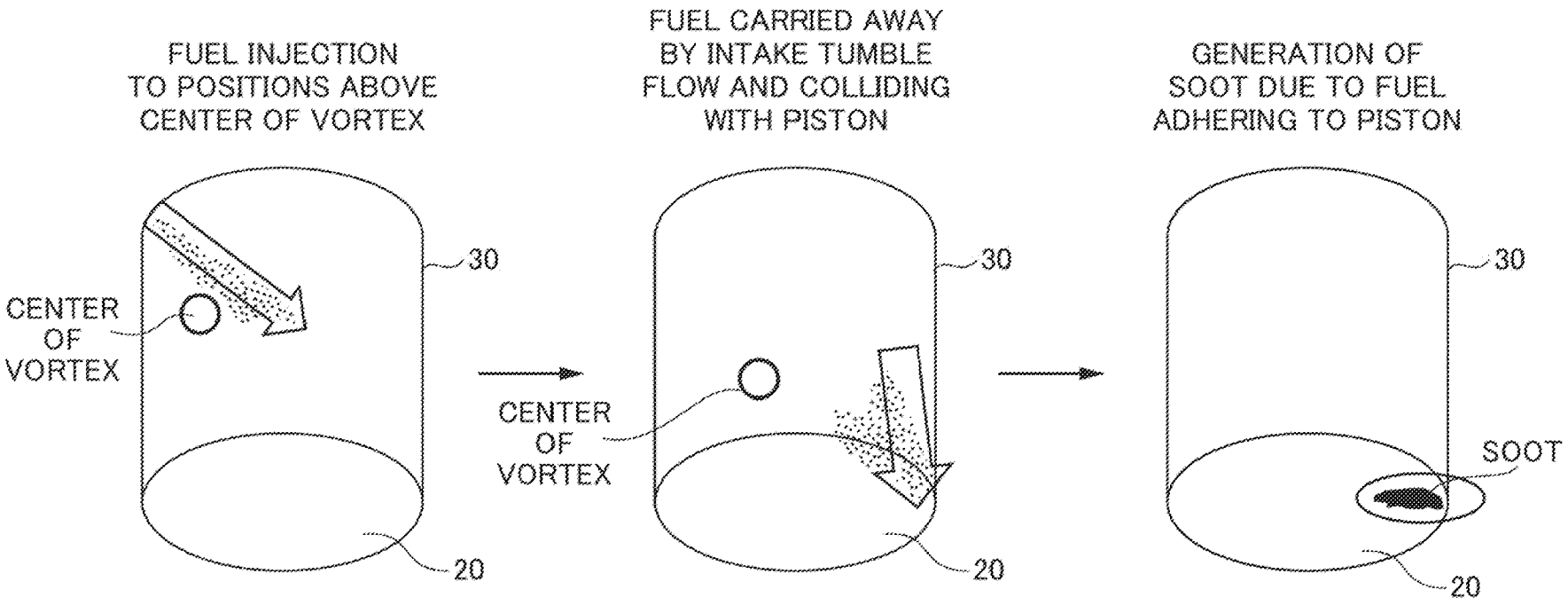
FIG. 6 is a diagram illustrating a flow of fuel injected from a sixth nozzle hole of an injector of a conventional internal combustion engine.

A fuel injection operation of the engine 1 of the present embodiment having the above-described configuration will be described in detail with reference to FIGS. 5 and 6. FIG. 5 is a diagram illustrating a flow of fuel injected from the sixth nozzle hole 126 of the injector 10 included in the engine 1 according to the present embodiment. FIG. 6 is a diagram illustrating a flow of fuel injected from a sixth nozzle hole of an injector included in a conventional engine. The injector of the conventional engine corresponding to FIG. 6 is configured such that all of first to sixth nozzle holes inject fuel to a space above the center of a vortex of an intake air tumble flow and have the same nozzle hole diameter.

As illustrated in FIG. 6, in the conventional engine, the sixth nozzle hole injects fuel toward a position above the center of the vortex of the intake tumble flow. The injected fuel is then carried away by the intake tumble flow toward the cylinder sleeve end to collide with the vicinity of the cylinder sleeve end. As a result of the collision, the fuel adheres to the top surface of the piston. The fuel deposits and forms soot.

In contrast, as illustrated in FIG. 5, in the engine 1 of the present embodiment, the sixth nozzle hole 126 injects fuel toward the center of a vortex of an intake tumble flow. The injected fuel then stagnates around the center of the vortex of the intake tumble flow, whereby the fuel is inhibited from adhering to the piston.

Here, results of a simulation according to computational fluid dynamics (CFD), conducted on the engine 1 of the present embodiment and the conventional engine of FIG. 6 are now described. The CFD simulation was conducted under the conditions of an engine speed of 3000 rpm and an engine torque of 160 Nm. The results demonstrated that the amount of fuel adhering to the piston was 0.51 mg in the conventional engine of FIG. 6, while the amount of fuel adhering to the piston was 0.12 mg in the engine 1 of the present embodiment. From the simulation results, it has been confirmed that the engine 1 of the present embodiment can significantly reduce adhesion of fuel to the piston, in comparison with the conventional engine.

The present embodiment exerts the following effects. According to the present embodiment, among the plurality of nozzle holes of the injector 10, the sixth nozzle hole 126, the axial direction of which is the most deflected toward the piston 20, has a nozzle hole diameter larger than those of the other nozzle holes, and the nozzle hole diameter of the sixth nozzle hole 126 corresponds to at least 20% of the total of the nozzle hole diameters of the other nozzle holes. According to the injector 10 of the present embodiment, the sixth nozzle hole 126, the axial direction of which is the most deflected toward the piston 20, can point and inject fuel toward the center of a vortex having weak flow in an intake air tumble flow having at least vertical swirl flow. In addition, the sixth nozzle hole 126, the axial direction of which is the most deflected toward the piston 20, has a larger nozzle hole than any of the other nozzle holes, whereby the fuel is caused to stagnate around the center of the vortex and is inhibited from adhering to the piston 20. As a result, adhesion of the fuel to the piston 20 can be inhibited, and generation of soot can be reduced.

In the present embodiment, all the other nozzle holes are arranged such that when viewed in an isometric perspective view, division of the length of a straight line extending from the center of each nozzle hole in the axial direction of the nozzle hole to the opposite side wall surface 31 of the cylinder 30 by the nozzle hole diameter of the nozzle hole gives a quotient of 545 or more. At the same time, all the other nozzle holes are arranged such that when viewed in a planar view, division of the length of a straight line extending from the center of each nozzle hole in the axial direction of the nozzle hole to the opposite side wall surface 31 of the cylinder 30 by the nozzle hole diameter of the nozzle hole gives a quotient of 393 or more. This feature makes it possible to further reliably inhibit fuel from adhering to the piston 20 and to further reliably reduce generation of soot.

According to the present embodiment, the second nozzle hole 122 and the third nozzle hole 123 have a smaller nozzle hole diameter than the first nozzle hole 121, the fourth nozzle hole 124, and the fifth nozzle hole 125. This feature exerts, in addition to the above-described effects, an effect of inhibiting interference between the fuel flows injected from the nozzle holes.

It should be noted that the above-described embodiment is not intended to limit the present disclosure, and the scope of the present disclosure encompasses modifications and variations that are made within the range in which the object of the present disclosure is achieved.

EXPLANATION OF REFERENCE NUMERALS

1: Engine
2: Cylinder Block
3: Cylinder Head
4: Combustion Chamber
5: Ignition Plug
10: Injector
11: Injector Body
12: Nozzle
20: Piston
30: Cylinder
31: Side Wall Surface
121: First Nozzle Hole
122: Second Nozzle Hole
123: Third Nozzle Hole
124: Fourth Nozzle Hole
125: Fifth Nozzle Hole
126: Sixth Nozzle Hole

What is claimed is:

1. An internal combustion engine comprising:

a piston;

a cylinder accommodating the piston; and an injector comprising a nozzle that has a plurality of nozzle holes configured to inject fuel into the cylinder from above the cylinder, wherein among the plurality of nozzle holes, one nozzle hole, an axial direction of which is most deflected toward the piston, has a nozzle hole diameter larger than nozzle hole diameters of other nozzle holes, wherein the nozzle hole diameter of the one nozzle hole corresponds to at least 20% of a total of the nozzle hole diameters of the other nozzle holes, wherein the plurality of nozzle holes comprise:

a first nozzle hole as an uppermost one among the plurality of nozzle hole;

a sixth nozzle hole as a lowermost one among the plurality of nozzle holes, the sixth nozzle hole having the axial direction that is the most deflected toward the piston;

a second nozzle hole and a third nozzle hole that are disposed at positions symmetrical to each other with respect to a center line passing through a center of the first nozzle hole and a center of the sixth nozzle hole, and that are adjacent to the first nozzle hole; and a fourth nozzle hole and a fifth nozzle hole that are disposed at positions symmetrical to each other with respect to the center line and that are adjacent to the sixth nozzle hole, and wherein the nozzle hole diameters of the second and third nozzle holes are smaller than those of the first, fourth, and fifth nozzle holes.

2. The internal combustion engine according to claim 1, wherein all the other nozzle holes are arranged such that when viewed in an isometric perspective view, division of a length of a straight line extending from a center of all the other nozzle hole in the axial direction of the nozzle hole to an opposite side wall surface of the cylinder by the nozzle hole diameter of the nozzle hole gives a quotient of 545 or more, and wherein all the other nozzle holes are arranged such that when viewed in a planar view, division of a length of a straight line extending from the center of each nozzle hole in the axial direction of the nozzle hole to the opposite side wall surface of the cylinder by the nozzle hole diameter of the nozzle hole gives a quotient of 393 or more.

* * * * *